US006592427B1

(12) United States Patent
Wilhelm et al.

(10) Patent No.: US 6,592,427 B1
(45) Date of Patent: Jul. 15, 2003

(54) TOY VEHICLE GRAIN LOADER ACCESSORY

(75) Inventors: Michael G. Wilhelm, Sycamore, IL (US); Gregory R. Kieso, Chicago, IL (US); Gary Aigner, Chicago, IL (US)

(73) Assignee: Learning Curve International, Inc., Chicago, IL (US)

( * ) Notice: Subject to any disclaimer, the term of this patent is extended or adjusted under 35 U.S.C. 154(b) by 0 days.

(21) Appl. No.: 09/501,410

(22) Filed: Feb. 9, 2000

Related U.S. Application Data

(60) Provisional application No. 60/119,672, filed on Feb. 11, 1999.

(51) Int. Cl.[7] ..... A63H 17/14

(52) U.S. Cl. ..... 446/427; 446/130; 446/424; 446/129; 105/1.5

(58) Field of Search ..... 446/427, 424, 446/428, 483, 441, 168, 171, 172, 129, 130, 446, 447, 475; 105/1.5, 157.2, 238.2

(56) References Cited

U.S. PATENT DOCUMENTS

| | | | | | |
|---|---|---|---|---|---|
| 871,823 | A | * | 11/1907 | Robinson | 446/424 |
| 1,099,507 | A | * | 6/1914 | Marshall | 446/172 |
| 2,036,076 | A | * | 3/1936 | Philippi | 446/129 |
| 2,290,844 | A | | 7/1942 | Smith | |
| 2,373,271 | A | | 4/1945 | Smith | |
| 2,581,201 | A | | 1/1952 | Pettit | |
| 3,054,214 | A | | 9/1962 | Smith et al. | |
| 3,071,890 | A | * | 1/1963 | Cohn | 446/424 |
| 3,196,566 | A | * | 7/1965 | Littlefield | 446/129 |
| 3,277,294 | A | * | 10/1966 | Howell | 446/129 |
| 4,068,402 | A | * | 1/1978 | Tanaka | 446/477 |
| 4,458,440 | A | * | 7/1984 | D'Andrade et al. | 446/424 |
| 5,131,881 | A | * | 7/1992 | Okada | 446/424 |
| 5,441,435 | A | * | 8/1995 | Shiraishi | 446/424 |
| 5,916,007 | A | * | 6/1999 | Maxim | 446/130 |
| 5,931,714 | A | * | 8/1999 | Johnson | 446/129 |

FOREIGN PATENT DOCUMENTS

| | | |
|---|---|---|
| GB | 2 241 903 A | 9/1991 |
| WO | WO 95/12444 | 5/1995 |
| WO | WO 99/38593 | 8/1999 |

OTHER PUBLICATIONS

Woodtrains.com, Internet, Thomas Buildings, Stations & Equipment, Copyright© 1999–2002.*

* cited by examiner

*Primary Examiner*—Derris H. Banks
*Assistant Examiner*—Urszula M Cegielnik
(74) *Attorney, Agent, or Firm*—Wallenstein & Wagner, Ltd.

(57) ABSTRACT

A toy vehicle set accessory is claimed. The toy vehicle set accessory comprises a grain loader and a toy vehicle adapted for use with the grain loader. The grain loader comprises a grain elevator assembly for simulating the transfer of grain to the toy vehicle. The toy vehicle includes a movable load and a release mechanism for returning the movable load from an unstable condition to a stable condition.

16 Claims, 3 Drawing Sheets

TOY VEHICLE GRAIN LOADER ACCESSORY

RELATED APPLICATION

This Application claims the benefit of Provisional Patent Application Serial No. 60/119,672, filed Feb. 11, 1999.

DESCRIPTION

1. Technical Field

The present invention relates generally to toy vehicle track accessories with moving parts and, more particularly, to a toy grain loader assembly and grain car for inclusion in a toy vehicle railway system.

2. Background

In the toy vehicle industry, small toy trains are often run on plastic or wooden tracks. These railway systems are designed to grow with the child. In other words, railway configurations can range from very simple ovals to complex systems incorporating bridges, buildings, tunnels, and towns. Many other accessories are available as well, such as toy figurines, bushes, shrubs, and trees to lend the system a realistic effect; playmats, playboards, and play tables on which to build a railway system; carry bags and boxes in which to store the railway system when not in use; and, storybooks, iron-ons, decals, and coloring books to further stimulate the child's imagination.

The railway configurations are built from individual track sections. The track sections range in size and shape. There are countless possibilities for individual track sections: some are straight; some feature switching mechanisms; some are curved; and, some are ascending for connection to another track positioned at a higher level.

One of the most important aspects of these railway systems is that the track sections be interchangeable. Accordingly, most track sections include male and/or female connectors at opposing ends. This allows the track sections to be connected end to end in a variety of configurations. Adding to the interchangeability of the track sections is the fact that these track sections are usually reversible having rails impregnated on both sides.

In addition, designers are constantly seeking to impart realism to the toy railway systems. In order to do this, designers have sought to introduce miniature accessories that resemble their real life counterparts. For example, locomotive turntables, highway crossings, lighthouses, tunnels, engine sheds, platform stations, draw bridges, windmills, and locomotive roundhouses are but a few of the many accessories available to add realism to the toy railway systems.

In particular, designers have discovered that children enjoy playing with accessories that have moving parts and/or produce sounds. Accordingly, many of the accessories currently available include movable parts such as levers, rotational handles, lifting mechanisms, and the like. Other accessories produce sounds. These include toy tracks that are designed to reproduce the sound an actual locomotive makes as it travels on actual train tracks, and locomotive whistles.

Thus, toy designers are always seeking to improve toy railway systems by introducing novel and interesting accessories which will capture a child's imagination.

SUMMARY OF THE INVENTION

This invention relates to a toy vehicle set accessory having moving parts such as a grain loader. The grain loader is devised to be incorporated into a toy vehicle railway system. The grain loader comprises a grain elevator assembly and a housing through which a toy vehicle can travel.

The grain elevator assembly includes a grain storage bin, a hopper, and an activation handle which when turned, transfers simulated grain pellets from the grain storage bin to the hopper. The storage bin includes a transfer belt for moving the grain pellets upwardly towards the hopper.

The hopper is produced from a transparent material. This allows the pellets to be visible as they are transferred from the grain storage bin. The hopper has a return chute through which the pellets return to the grain storage bin.

The housing comprises opposing side walls, a roof, an entrance, and an exit. The housing also includes a pair of parallel grooves on which a toy vehicle may travel. A first magnet is imbedded in each of the end walls.

A toy vehicle grain car is used in combination with the grain loader. A self-contained, rotatable load is stored within the toy vehicle. The rotatable load includes a flat, simulated wood surface on one side for simulating an empty grain car and a curved, simulated grain surface on an opposing side for simulating a laden grain car.

The toy vehicle comprises a pair of opposing side walls which are joined by a pair of opposing end walls. Each end wall includes a recess for receiving the outwardly projecting pins of the rotatable load. The rotatable load is spring loaded within the vehicle body so that the simulated grain surface is facing upwardly when the rotatable load is in its stable condition.

A release mechanism is located along one of the side walls. The rotatable load is in its unstable condition when the spring is stressed. When the release mechanism is activated, the force from the spring returns the rotatable load to its stable orientation with the simulated grain surface facing upwardly.

DETAILED DESCRIPTION

Figure 1:
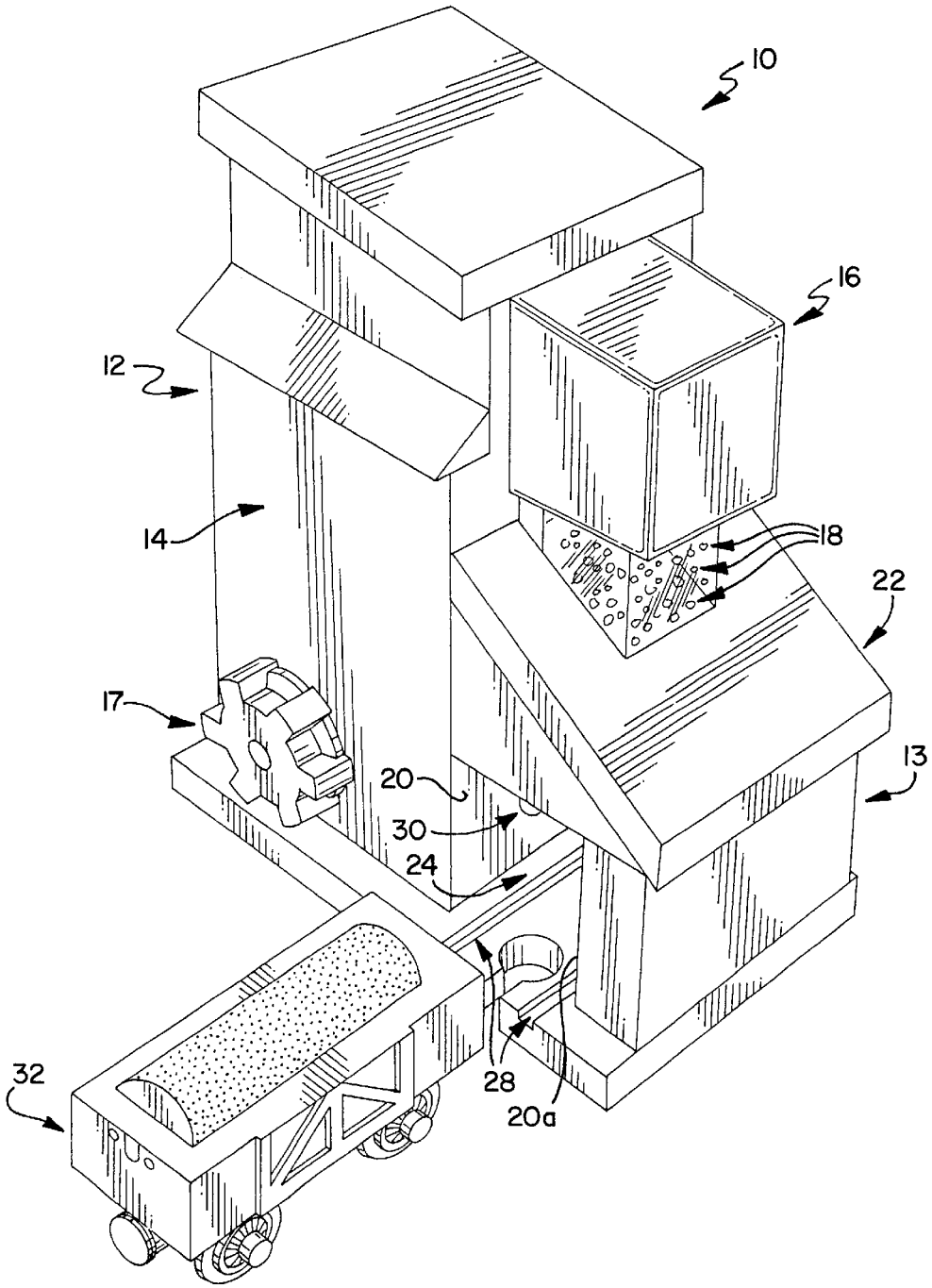
FIG. 1 is a perspective view of a toy vehicle set accessory of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring to FIG. 1, a toy vehicle accessory of the present invention is illustrated. The toy vehicle accessory includes a toy vehicle set grain loader 10. The grain loader 10 is devised to be incorporated into a toy vehicle railway system. Thus, the grain loader 10 comprises a grain elevator assembly 12 and a housing 13 through which a toy vehicle can travel.

Figure 2:
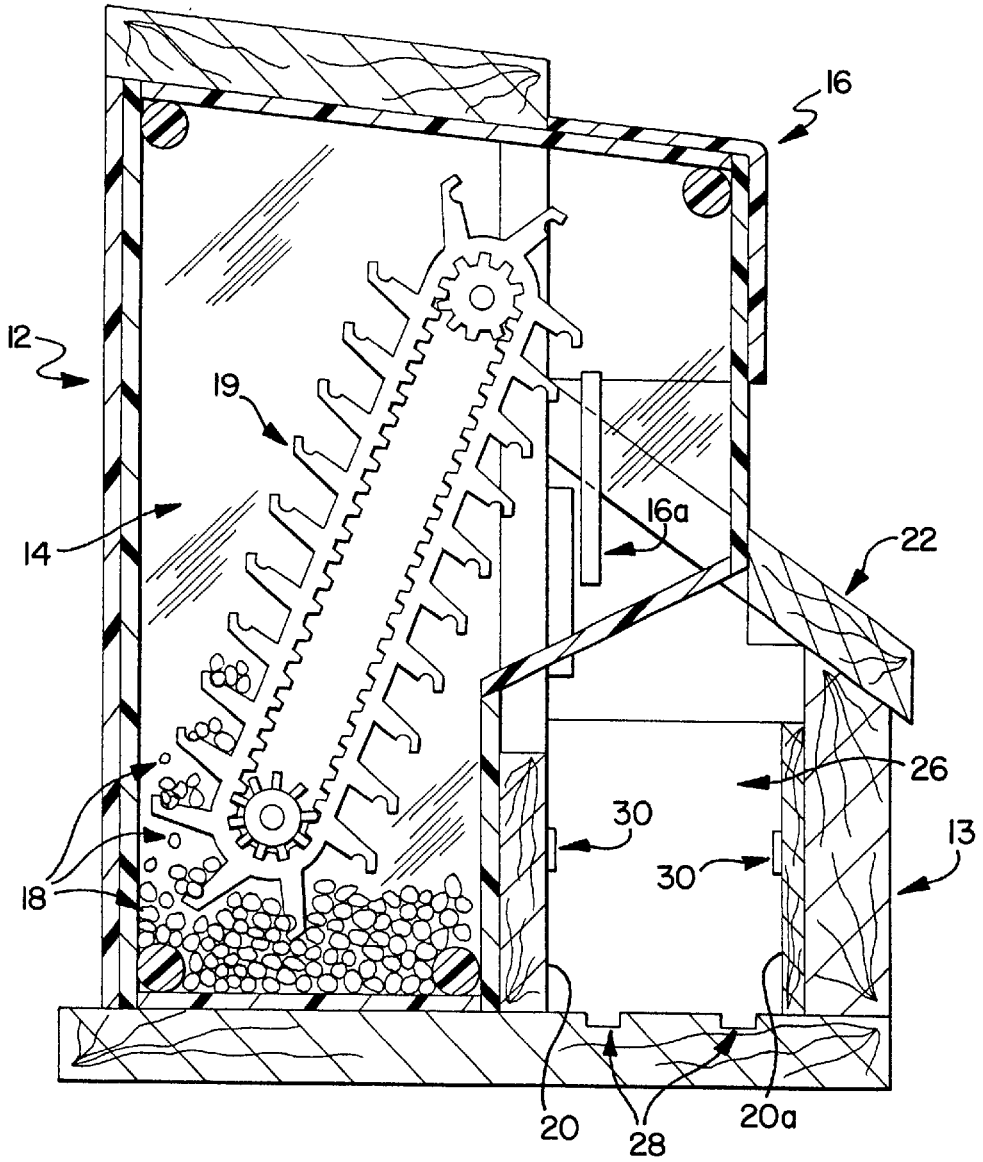
FIG. 2 is a cut-away side view of a toy vehicle accessory of the present invention.

The grain elevator assembly 12 simulates the transfer of grain to a toy vehicle. The grain elevator assembly 12 includes a grain storage bin 14, a hopper 16, and an activation handle 17 which when turned, transfers simulated grain pellets 18 from the grain storage bin 14 to the hopper 16. The storage bin 14 includes a transfer belt 19 for moving the grain pellets 18 upwardly towards the hopper 16. (See FIG. 2). By rotating the activation handle 17, movement is transferred to the transfer belt 19 which in turn moves the pellets 18 upwardly through the grain elevator assembly 12 to the hopper 16.

The hopper 16 is produced from a transparent material. This allows the pellets 18 to be visible as they are transferred from the grain storage bin 14. The hopper 16 has a return chute 16*a* through which the pellets 18 return to the grain storage bin 14. The chute 16*a* allows the pellets 18 to be recycled continuously through the grain elevator assembly 12 so that the pellets 18 never need to be replaced.

The housing 13 comprises opposing side walls 20, 20*a*, a roof 22, an entrance 24, and an exit 26. The housing 13 also includes a pair of parallel grooves 28 on which a toy vehicle may travel. A first activation member, preferably a magnet, 30 is imbedded in each of the end walls 20. The purpose of the first magnet 30 will become clear on further description.

Figure 3:
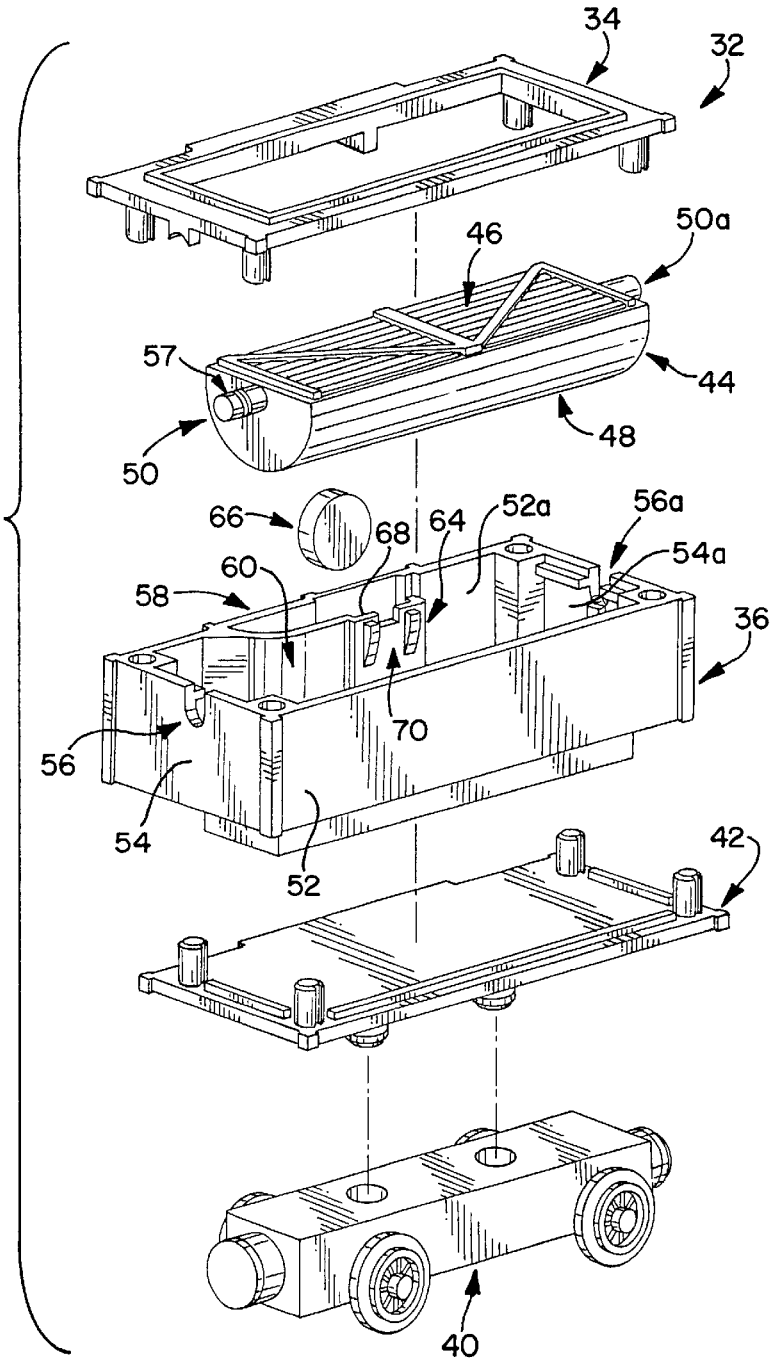
FIG. 3 is an exploded view of a toy vehicle of the present invention.

FIG. 3 is an exploded view of a toy vehicle grain car 32 which is used in combination with the grain loader 10. The toy vehicle 32 comprises a cap portion 34 which fits over a vehicle body 36. The vehicle body 36, which is incorporated into a chassis, is supported above two pairs of wheels 40 by a base portion 42. A self-contained, rotatable load 44 is stored within the vehicle body 36. The rotatable load 44 includes a flat, simulated wood surface 46 on one side for simulating an empty grain car 32 and a curved, simulated grain surface 48 on an opposing side for simulating a laden grain car 32. The rotatable load 44 further includes a pair of outwardly projecting pins 50, 50*a* on which the load 44 can rotate within the vehicle body 36.

The vehicle body 36 comprises a pair of opposing side walls 52, 52*a* which are joined by a pair of opposing end walls 54, 54*a*. Each end wall 54, 54*a* includes a recess 56, 56*a* for receiving the outwardly projecting pins 50, 50*a* of the rotatable load 44. The rotatable load 44 is spring loaded by a spring member 57 within the vehicle body 36 so that the simulated grain surface 48 is facing upwardly when the rotatable load 44 is in its stable condition.

A release mechanism 58 is located along one of the side walls 52, 52*a*. The purpose of the release mechanism 58 is to selectively hold the rotatable load 44 with the simulated wood surface 46 facing upwardly when the spring 57 is stressed. The rotatable load 44 is in its unstable condition when the spring 57 is stressed. When the release mechanism 58 is activated, the force from the spring 57 returns the rotatable load 44 to its stable orientation with the simulated grain surface 48 facing upwardly. The release mechanism 58 comprises flexible partition 60 having a fixed end 62 and a free end 64. The fixed end is attached to one of the side walls 52, 52*a*. The free end 64 is spaced from the side wall 52, 52*a*. A second activation member, preferably a magnet, 66 is fixedly attached to an inner wall 68 of the flexible partition 60. A keeper 70 projects from an outer wall towards the rotatable load 44. The keeper 70 holds the rotatable load 44 in position when the rotatable load 44 is in its unstable condition with the spring 57 stressed and the simulated wood surface 46 is facing upwardly. The release mechanism 58 provided with first and second activation members 30, 66 and a load 44 having a stable condition and an unstable condition may be provided in any number of toy vehicle accessories without departing from the spirit of the invention.

In use, the toy vehicle 32 enters the grain loader's 10 housing 13 with the spring 57 stressed and the rotatable load 44 in its unstable condition with the simulated wood surface 46 facing upwardly. When the first magnet is brought into approximate alignment with the second magnet, the first magnet 30 imbedded in the housing's 13 side walls 20, 20*a* attracts the second magnet 66 located in the release mechanism 58. The attraction between the magnets pulls the flexible partition 60 towards the vehicle body's 36 side wall 52, 52*a*. The flexible partition's 60 movement releases the keeper 70 from the rotatable load 44, and the rotatable load 44 returns to its stable condition with the spring 57 not stressed and the simulated grain surface 48 facing upwardly. Once the toy vehicle 32 has exited the grain loader 10, the rotatable load 44 can be manually reset from the stable orientation to the unstable orientation.

While a specific embodiment has been illustrated and described, numerous modifications are possible without departing from the spirit of the invention, and the scope of protection is only limited by the scope of the accompanying claims.

What is claimed is:

1. A toy vehicle set accessory for use in a toy vehicle system comprising a plurality of vehicle track segments over which a toy vehicle travels, the toy vehicle set accessory comprising:

a loader assembly for simulating a transfer of a material:

a toy vehicle for simulating a receiving of the material, the toy vehicle comprising a self-contained, movable load for alternately simulating an empty car condition and a laden car condition, and a release mechanism for biasing the self-contained, movable load between an unstable orientation and a stable orientation.

2. The toy vehicle set accessory of claim 1 wherein the self-contained, moveable load is spring-loaded.

3. The toy vehicle set accessory of claim 2 wherein the release mechanism comprises a flexible partition extending from a side wall of the toy vehicle for selectively maintaining the spring-loaded, self-contained movable load in the unstable condition.

4. The toy vehicle set accessory of claim 3 wherein the flexible partition is attached to the side wall of the toy vehicle at a fixed end and spaced from the side wall at a free end, the free end including a keeper for selectively maintaining the spring-loaded, self-contained movable load in the unstable condition.

5. The toy vehicle set accessory of claim 4 wherein a first magnet is fixedly attached to the loader assembly and the release mechanism further comprises a second magnet fixedly attached to the flexible partition wherein an attractive force between the first and second magnets causes the free end of the flexible partition to bend toward the toy vehicle side wall releasing the spring-loaded, self-contained movable load to the laden car position.

6. The toy vehicle set accessory of claim 1 wherein the loader assembly comprises an elevator assembly comprising a storage bin for holding the material and a transfer belt for transferring the material from the storage bin upwardly to a hopper having a chute through which the material returns to the storage bin.

7. The toy vehicle set accessory of claim 6 wherein the transfer belt is interconnected to an activation handle for providing movement to the transfer belt.

8. The toy vehicle set accessory of claim 7 wherein the loader assembly includes a toy vehicle track segment over which the toy vehicle can traverse.

9. A toy vehicle set accessory for use in a toy vehicle system comprising a plurality of toy vehicle track segments over which a toy vehicle travels, the toy vehicle set accessory comprising:

a grain loader including a grain elevator assembly having a grain storage bin and a transfer belt for transferring a plurality of simulated grain pellets upwardly to a hopper and interconnected to an activation handle for providing movement to the transfer belt; and a toy vehicle having a vehicle body and a release mechanism for biasing a spring-loaded cargo rotatable about a longitudinal axis between an unstable orientation and a stable orientation.

10. The toy vehicle set accessory of claim 9 wherein the hopper comprises a chute for returning the simulated grain pellets from the hopper to the grain storage bin.

11. The toy vehicle set accessory of claim 10 wherein the grain loader comprises a housing having a pair of opposing housing walls, an entrance, an exit, and a track section over which the toy vehicle can traverse.

12. The toy vehicle set accessory of claim 10 wherein the release mechanism comprises a flexible partition extending from a side wall of the toy vehicle for selectively maintaining the spring-loaded, rotating cargo in the unstable condition.

13. The toy vehicle set accessory of claim 12 wherein the flexible partition is attached to the toy vehicle body at a fixed end and spaced from the side wall at a free end, the free end comprising a keeper for selectively maintaining the spring-loaded, rotatable cargo in the unstable condition.

14. The toy vehicle set accessory of claim 13 wherein a first magnet is fixedly attached to the grain loader and the release mechanism further comprises a second magnet fixedly attached to the flexible partition wherein an attractive force between the first and second magnets causes the free end of the flexible partition to bend away from the spring-loaded rotatable cargo releasing the spring-loaded, rotatable load to the stable orientation.

15. A toy vehicle set accessory for use in a toy vehicle system comprising a plurality of toy vehicle track segments over which a toy vehicle travels, the toy vehicle set accessory comprising:

a grain loader including a grain elevator assembly and a housing, the grain elevator assembly including a grain storage bin having a transfer belt for transferring a plurality of simulated grain pellets upwardly to a hopper and interconnected to an activation handle for providing movement to the transfer belt, the hopper including a pair of opposing, transparent side walls and a return chute for transferring the simulated grain pellets from the hopper to the grain storage bin, and the housing including a pair of opposing housing walls, first magnet fixedly attached to one of the housing walls, an entrance, an exit, and a track section over which a toy vehicle can traverse; and a grain car attachable to another toy vehicle including a vehicle body, a release mechanism for biasing a spring-loaded rotatable load between an unstable orientation and a stable orientation, the release mechanism including a flexible partition and a second magnet, the flexible partition being attached to the vehicle body at a fixed end and spaced from the vehicle body at a free end, the free end having a keeper for engaging a portion of the rotatable load and preventing the rotatable load from returning to the stable orientation, and the second magnet fixedly attached to the free end of the flexible partition wherein an attractive force between the second magnet of the grain car and the first magnet of the grain loader draws the flexible partition toward the vehicle body and releases the rotatable load from the keeper and the rotatable load moves from the unstable orientation to the stable orientation.

16. A toy vehicle set accessory for use in a toy vehicle system comprising a plurality of vehicle track segments over which a toy vehicle travels, the toy vehicle set accessory comprising:

a base assembly including a track segment and a first activation member attached to a portion of the base assembly in a fixed position relative to the track segment;

a toy vehicle for traversing along the track segment, the toy vehicle including a second activation member substantially alignable with the first activation member located on the base assembly;

a magnet for providing a magnetic force between the first and second activation members; and a load having a stable condition and an unstable condition and retained in the unstable condition by a release mechanism operably connectable with the first or second activation member wherein substantial alignment of the first and second activation members creates the magnetic force between the first and second activation members and causes the release mechanism to operably release the load from the unstable condition to the stable condition.

* * * * *